US007581406B2

(12) United States Patent
Sekiyama

(10) Patent No.: US 7,581,406 B2
(45) Date of Patent: Sep. 1, 2009

(54) SYSTEM FOR DISTRIBUTING THE COMMODITIES REQUIRING COLD PACKING

(75) Inventor: Tadashi Sekiyama, Kamakura (JP)

(73) Assignee: Nikken Rentacom Co., Ltd., Tokyo (JP)

( * ) Notice: Subject to any disclaimer, the term of this patent is extended or adjusted under 35 U.S.C. 154(b) by 867 days.

(21) Appl. No.: 11/095,471

(22) Filed: Apr. 1, 2005

(65) Prior Publication Data

US 2005/0217304 A1 Oct. 6, 2005

(30) Foreign Application Priority Data

Apr. 2, 2004 (JP) ..... 2004-109927
Apr. 2, 2004 (JP) ..... 2004-110390

(51) Int. Cl.
*B65B 63/08* (2006.01)

(52) U.S. Cl. ..... 62/60; 62/371

(58) Field of Classification Search ..... 62/60, 62/371

See application file for complete search history.

(56) References Cited

U.S. PATENT DOCUMENTS 2,096,958 A * 10/1937 Clerc ..... 414/276
7,140,773 B2 * 11/2006 Becker et al. ..... 383/99

* cited by examiner

*Primary Examiner*—Melvin Jones
(74) *Attorney, Agent, or Firm*—Townsend & Banta

(57) ABSTRACT

A system for distributing commodities such as foods requiring cold packing, such as frozen sea foods, chilled foods, cooled foods, etc., in disposable cold insulation boxes which can use ice and/or dry ice to cool these foods. This system comprises a packing facility for packaging commodities, into repetitively usable cold insulation boxes together with a repetitively usable cold insulating material, to produce cooled packages, a distribution facility for stacking resultant cooled packages for distribution to customers, a renewing facility for renewing used cold insulating material and used cold insulation boxes to facilitate their reuse, and a stock facility for stocking the renewed cold insulating material and the renewed cold insulation boxes, as components of the system, wherein each of the cold insulation boxes consists of a box body and a cover, and opening action proving tapes are stuck to straddle the body box and cover to couple them together.

10 Claims, 7 Drawing Sheets

SYSTEM FOR DISTRIBUTING THE COMMODITIES REQUIRING COLD PACKING

BACKGROUND OF THE INVENTION

1. Field of the Invention

The present invention relates to a distribution system for foods that must be essentially cold-insulated during transport, for example, frozen foods such as frozen sea foods, chilled foods and cooled foods, foods to be preferably cold-insulated, and various other commodities, which are generally called commodities requiring cold packing in this specification.

2. Description of the Prior Art

Various commodities requiring cold packing as described above are accommodated in cold insulation boxes with thermal insulation capability such as styrene foam boxes together with a cold insulating material such as ice or dry ice, and transported using, for example, refrigerating vans and thermally insulated vans, in order to prevent the deterioration of quality otherwise caused by temperature rise. This practice is widely employed.

For example, JP9-170860A (Japanese patent document) discloses a method for transporting commodities requiring cold packing, using an insulated van in which a liquefied gas such as liquid carbonic acid gas or liquid nitrogen gas is injected for supply into a space formed above a snow receiver installed above an enclosed container accommodating the commodities requiring cold packing, for quickly cooling the interior of the space. In the quick cooling method as described above, if liquid carbonic acid gas is injected at room temperature, for example, 47% of it becomes snow dry ice while the remaining 53% becomes gas. Since the weight of carbonic acid gas is about 1.5 times the weight of air, it stays at a low place.

Furthermore, JP11-236077A (Japanese patent document) discloses a cold insulation box used for transporting perishable food, which can accommodate perishable food together with a cold insulating material without damaging the perishable food, and in which since the cold air generated by the cold insulating material is not suddenly applied to the perishable food, the perishable food can be uniformly cooled without being partially discolored. As for the cold insulation box for transport, particularly, a cold insulation sheet produced by vapor-depositing a metal on one or both sides of a foamable cushioning sheet or by sticking a metal foil or a metal vapor-deposited film is placed in the cold insulation box, and a cold insulating material is accommodated on one side of the cold insulation sheet while perishable food is accommodated on the other side, to ensure that the perishable food can be kept in contact with the metal-deposited side or the metal foil-stuck side or the metal vapor-deposited film-stuck side of the cold insulation sheet. In this case, as the cold insulating material, ice or dry ice or any of various cold reserving materials can be used, and frozen food itself can also be used as the cold insulating material.

The problem arising when ice is used as the cold insulating material is that water is generated due to thawing. Furthermore, in the case where dry ice is used as the cold insulating material, there arise the following problems.

1. When dry ice is handled, thick protective gloves must be worn, and sufficient ventilation is necessary to avoid oxygen deficiency, while a special container for storing it is necessary, to inconvenience working efforts.

2. Dry ice has a temperature as very low as −78.5° C., and a latent heat of 132.4 kcal/g. However, since the temperature is very different from room temperature, the duration of effective cold insulation is relatively short. Furthermore, when the commodities requiring cold packing are, for example, foods, the working temperature may be lower than the optimum temperature, and in this case, the quality may be deteriorated.

3. The production cost of dry ice is, for example, about 72.5 yen/kg, and since it can be used only once, the cost is so high that it does not allow the distribution cost to be lowered.

Furthermore, in the case where dry ice or ice is used as a cold insulating material, the duration of effective cold insulation is not long enough. So, somewhere in the distribution route from the package packing facility through the distribution facility to customers, the cold insulation boxes must be opened for being re-charged with the cold insulating material. This threatens to undermine the quality and safety of the commodities requiring cold packing.

In view of the above problems, in distribution of commodities requiring cold packing, the social demand for any other cold insulating material than dry ice is sharply growing.

However, in the case where a soft or hard container filled with a cold insulating agent such as a liquid in standard ambient temperature is used repetitively as a cold insulating material, the following problems arise.

1. Since a cold insulating material as much as 3 times the usually used amount must be kept in stock, the storage space and stock volume must be managed with additional expenses needed for them.

2. Since it is essential to wash and sterilize the cold insulating material to keep it clean whenever it has been used, additional expenses are needed for the equipment and personnel.

3. In the case where the cold reserving material is deteriorated due to temporal change, it must be disposed as waste with additional expenses needed for it.

4. If the container is inferior, it can be damaged after repetitive use, and the cold insulating material contained in it may leak dangerously. If the cold insulating material contains a toxic substance such as ethylene glycol, it is dangerous, and furthermore, there arises such a problem that a fungus, for example, a mold is generated.

On the other hand, also with regard to the cold insulation boxes, conventional simple boxes made of styrene foam or the like are used mostly only once since it is difficult to re-use them. This is undesirable waste of a resource.

SUMMARY OF THE INVENTION

The object of this invention is to solve the above-mentioned problems.

To solve the above-mentioned problems, the present invention proposes a system for distributing the commodities requiring cold packing, comprising a package packing facility for accommodating the commodities requiring cold packing, into repetitively usable cold insulation boxes together with a repetitively usable cold insulating material, to establish packages, a distribution facility for stacking the packed packages for distribution to customers, a renewing facility for renewing the used cold insulating material and the used cold insulation boxes to allow their reuse, and a stock facility for stocking the renewed cold insulating material and the renewed cold insulation boxes.

This invention also proposes said distribution system, wherein the renewing facility and the stock facility are provided in the same space as that of the package packing facility.

This invention also proposes said distribution system, wherein the renewing facility and the stock facility are provided to be common to plural package packing facilities.

This invention also proposes said distribution system, wherein the repetitively usable cold insulating material is anti-freezing enclosed containers respectively filled with a hygroscopic polymer-based cold insulating material.

This invention also proposes said distribution system, wherein the repetitively usable cold insulation boxes are made of polypropylene foam.

This invention also proposes said distribution system, wherein the repetitively usable cold insulation boxes are made of a plastic composite resin foam.

This invention also proposes said distribution system, wherein each of the repetitively usable cold insulation boxes is a box with a multi-layer structure consisting of an outer structural material and an inner thermally insulating material.

This invention also proposes said distribution system, wherein the cold insulating material and the cold insulation boxes are rentable.

This invention also proposes said distribution system, wherein in the case where the cold insulating material and the cold insulation boxes are rentable and where the renewing facility and the stock facility are provided to be common to plural package packing facilities, the rental agent manages the renewing facility and the stock facility.

This invention also proposes said distribution system, wherein each of the cold insulation boxes consists of a box body and a cover, and opening action proving tapes are stuck to straddle the box body and the cover coupled with each other. Furthermore, this invention proposes that each of the opening action proving tapes has its one end pre-fixed to either the cover or the box body; the other end of the tape has a portion to be bonded to the other member; and a region of the portion to be bonded at the other end is differently adhesive for allowing a performed opening action to be proved.

According to the distribution system of this invention described above, the packages, each of which has the commodities requiring cold packing accommodated in a cold insulation box together with a cold insulating material in the package packing facility, are at first transported to the distribution facility in the region of customers, and then they are transported from the distribution facility to the customers.

At each of the customers, the commodities requiring cold packing such as frozen foods or chilled foods in the cold insulation boxes are delivered, and the cold insulation boxes and the cold insulating material are recovered and brought back to the distribution facility.

The cold insulation boxes and the cold insulating material recovered to the distribution facility are transported to the renewing facility and respectively washed and sterilized by the washers installed there, then being transported to and stored at the stock facility.

In this case, the cold insulating material is quickly frozen by a freezer installed at the renewing facility or stock facility, and stored in a frozen state.

The cold insulation boxes and the cold insulating material stored in the stock facility as described above are supplied to the package packing facility as required and used again for distributing the commodities requiring cold packing.

The cold insulation boxes and cold insulating material, the quantities of which change depending on the distribution volume of the commodities requiring cold packing as described above, can be owned by the distributor concerned. However, it is very convenient if they are rentable.

In this case, if the rental agent concerned manages the renewing facility and the stock facility together with the cold insulation boxes and the cold insulating material, the distributor concerned can also be highly benefited.

On the other hand, if the renewing facility and the stock facility are provided in such a manner that the cold insulation boxes and the cold insulating material can be supplied commonly to the package packing facilities of plural distributors, the distribution volumes of the cold insulation boxes and the cold insulating material can be averaged advantageously for the rental agent.

Meanwhile, the renewing facility and the stock facility can be located in the same space as that of the package packing facility, and in this case, the distributor can also manage the renewing facility and the stock facility.

If the repetitively usable cold insulating material is anti-freezing enclosed containers respectively filled with a hygroscopic polymer-based cold insulating agent, the temperature can be set in response to the commodities requiring cold packing, and the temperature difference from room temperature can be made smaller compared with that of dry ice. So, the commodities can be kept cold for a long period of time. Furthermore, since the freezing and storing temperature can be kept higher than that of dry ice, freezing and storage can be facilitated.

In this invention, in the constitution in which opening action proving tapes are stuck to straddle the box body and the cover of each of the cold insulation boxes, if the cover is opened somewhere in said distribution route, the fact of opening can be confirmed, and if a predetermined action is taken in this case, the safety of the commodity requiring cold packing can be enhanced.

For example, as for each of the opening action proving tapes, if one end of it is pre-fixed to either the cover or the box body while the other end has a portion to be bonded to the other member, the sticking work at the package packing facility is easy.

DETAILED DESCRIPTION OF THE PREFERRED EMBODIMENTS

Figure 1:
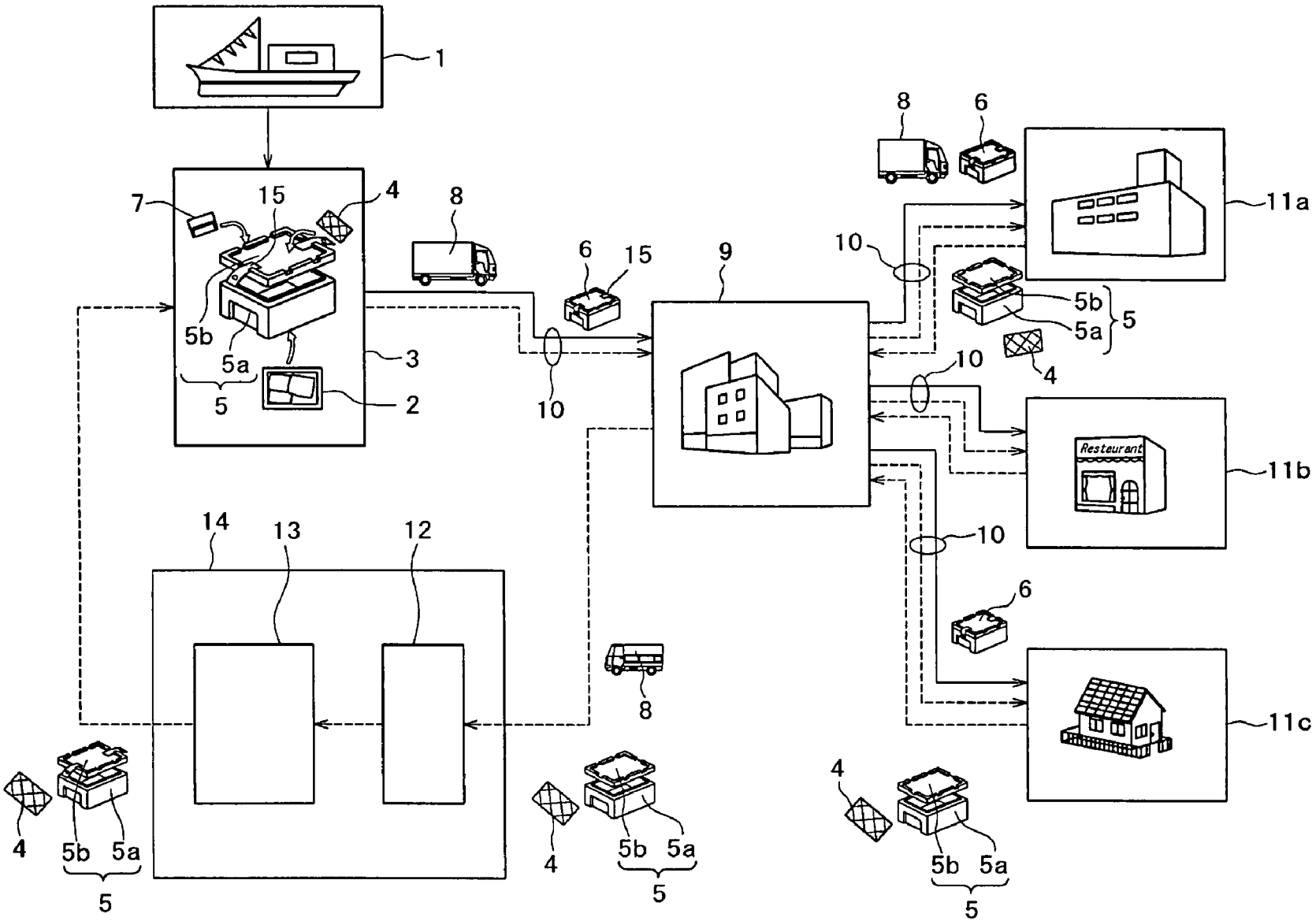
FIG. 1 is a systematic illustration for explaining simplified distribution routes in the system for distributing the commodities requiring cold packing of this invention, as a first example with processed marine products as the commodities requiring cold packing.

The entire constitution of the system of this invention is explained below in reference to FIG. 1 showing a first example.

FIG. 1 is a systematic illustration for explaining simplified distribution routes in the system for distributing the commodities requiring cold packing of this invention, as a first example with processed marine products as the commodities requiring cold packing.

Symbol 1 denotes a producer. In this case, the producer can be a fishery company or the like who catches or cultures marine products as the raw materials of processed marine products, or a freezing company who processes the raw materials transported from a producer, for producing processed marine products as the commodities requiring cold packing 2.

Symbol 3 denotes a package packing facility managed by a distributor. The package packing facility 3 is a facility in which the commodities requiring cold packing 2 are accommodated into cold insulation boxes 5 together with a cold insulating material 4, to establish packages 6.

In this case, the cold insulating material 4 and the cold insulation boxes 5 can be repetitively used as described later. Each of the cold insulation boxes 5 consists of a box body 5*a* and a cover 5*b*. Symbol 7 denotes a temperature data logger, and in this example, the temperature data logger 7 is accommodated in each of the cold insulation boxes 5 together with the commodity requiring cold packing 2 and the cold insulating material 4, to establish the package 6, so that the temperature in the cold insulation box 5 of the package 6 can be measured and recorded every set time period.

In this example, if the package 6 is established as described above, opening action proving tapes 15 are stuck to straddle the box body and the cover provided as the members of the cold insulation box, and the tapes are described later in detail in reference to FIGS. 3 to 9.

The distribution components described above are particularly explained below. At first, as the repetitively usable cold insulating material 4, for example, anti-freezing enclosed containers respectively filled with a hydroscopic polymer-based cold insulating agent can be used.

Each of the repetitively usable cold insulation boxes 5 can be, for example, a container having a cover and made of polypropylene foam, or a container having a cover and made of a plastic composite resin foam. The latter plastic composite resin foam is, for example, a composite resin foam consisting of polystyrene and polyethylene, and it is a functional plastic foam having both the stiffness of polystyrene and the viscosity of polyethylene. For example, a material called "Piocelan (registered trademark)" can be used.

The cold insulation box 5 made of the above-mentioned plastic foam is suitable as a component of the system of this invention, since it is excellent in cold insulation, durability, washing property, etc.

Furthermore, the repetitively usable cold insulation box 5 can also be a box with a multi-layer structure consisting of an outer stiff structural material and an inner thermally insulating material, namely, with a structure called "cooler box."

The process for distributing the packages 6 established as described above is explained below.

The packages 6 packed in the package packing facility 3 as described above are, at first, distributed by the transport means 8 of the distributor to a distribution facility 9 corresponding to a region of customers such as a regional distribution center. In the drawing, arrow lines indicate the transport movement and directions. Solid arrow lines indicate the movement of commodities requiring cold packing 2, and broken arrow lines indicate the movement of distribution components such as the cold insulation boxes 5 and the cold insulating material 4. Furthermore, in the drawing, each oval 10 covering both a solid arrow line and a broken arrow line indicates a state in which the commodity requiring cold packing 2 and the distribution components are integrated, i.e., a packed state.

The packages 6 transported from the package packing facility 3 to the distribution facility 9 and stacked there as described above are then distributed to customers 11*a*, 11*b* and 11*c* such as retail shops, and unpacked there, to deliver the commodities requiring cold packing 2 such as frozen foods or chilled foods contained in the cold insulation boxes 5, and to recover the cold insulation boxes 5 and the cold insulating material 4 for bringing them back to the distribution facility 9. In the case where the temperature data loggers 7 are placed in the cold insulation boxes 5, they are sent to the managing company, etc.

The cold insulation boxes 5 and the cold insulating material 4 recovered from the customers 11 to the distribution facility 9 are then transported to a renewing facility 12 and washed and sterilized by respective washers (not shown in the drawing) installed there, then being transported to a stock facility 13, to be stored there. In this case, the cold insulating material 4 is quickly cooled by a freezer (not shown in the drawing) installed in the renewing facility 12 or the stock facility 13, and are stored in the stock facility 13 in a frozen state. The renewing facility 12 and the stock facility 13 can be provided separately, but can also be provided integrally as a renewing and stock facility 14.

The cold insulation boxes 5 and the cold insulating material stored in the stock facility 13 are supplied to the package packing facility 3 as required and used again for distributing the commodities requiring cold packing 2.

The cold insulation boxes and the cold insulating material, the quantities of which change depending on the distribution volume of the commodities requiring cold packing, can be owned by the distributor concerned, but it is very advantageous if they are rentable. In this case, if the rental agent concerned manages also the renewing facility 12 and the stock facility 13 or the renewing and stock facility 14 together with the cold insulation boxes 5 and the cold insulating material 4, the distributor can also be highly benefited.

In the above example, the renewing facility 12 and the stock facility 13 or the renewing and stock facility 14 is located at a position apart from the package packing facility 3, but can also be located in the space as or adjacent to or near that of the package packing facility 3 as the case may be, and the distributor per se can also manage them.

Figure 2:
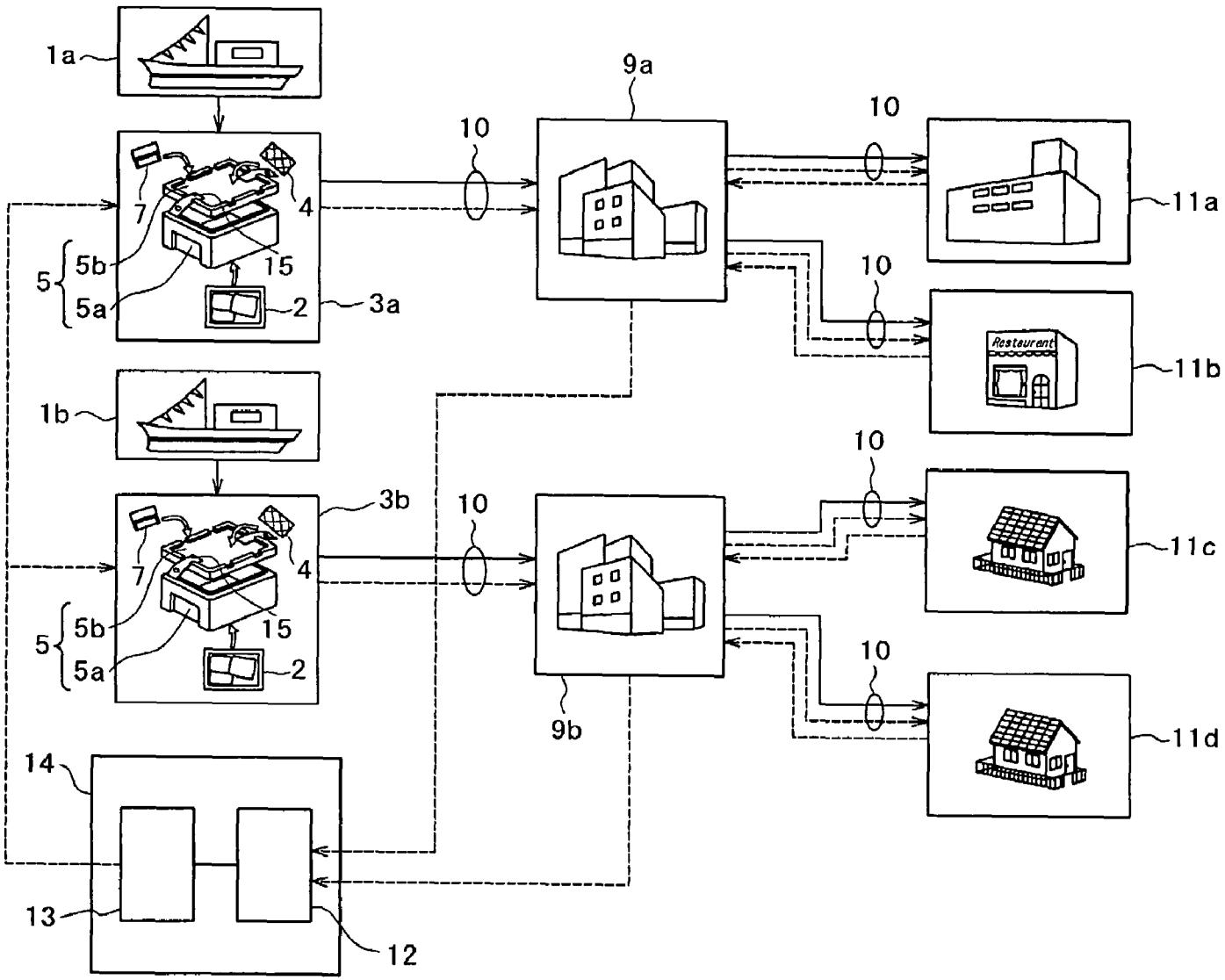
FIG. 2 is a systematic illustration for explaining simplified distribution routes in the system for distributing the commodities requiring cold packing of this invention, as a second example with processed marine products as the commodities requiring cold packing.

FIG. 2 shows the entire composition of the system of this invention as a second example.

In said distribution system of the second example, a renewing facility 12 and a stock facility 13 are provided as facilities common to plural producers 1*a* and 1*b*, plural package packing facilities 3*a* and 3*b* and plural distribution facilities 9*a* and 9*b*. The other constitution is the same as that of the first example. So, the corresponding components are given the same symbols to avoid double explanation.

In said distribution system of this example, as described above, the renewing facility 12 and the stock facility 13 are provided as facilities common to plural package packing facilities 3*a* and 3*b* and plural distribution facilities 9*a* and 9*b*, and a cold insulating material 4 and cold insulation boxes 5 are rentable. The rental agent manages the renewing facility 12 and the stock facility 13.

In the constitution of the above system, the packages 6, obtained by accommodating the commodities requiring cold packing 2 transported from the producers 1*a* and 1*b*, into the cold insulation boxes 5 together with the cold insulating material 4 in the respective package packing facilities 3*a* and 3*b*, are at first transported to the distribution facilities 9*a* and 9*b* corresponding to the regions of customers 11*a*, 11*b*, 11*c*, 11*d*, . . . , and subsequently, they are transported from the respective distribution facilities 9*a* and 9*b* to the customers 11, 11*b*, 11*c* and 11*d*.

As described before, the commodities requiring cold packing 2 such as frozen or chilled foods in the cold insulation boxes 5 are delivered to the customers 11*a*, 11*b*, 11*c* and 11*d*, and the cold insulation boxes 5 and the cold insulating material 4 are recovered and brought back to the respective distribution facilities 9*a* and 9*b*. Then, the cold insulation boxes 5 and the cold insulating material 4 recovered to the respective distribution facilities 9*a* and 9*b* are transported to a common renewing facility 12 and respectively washed and sterilized by the washers installed there, then being transported to and stored in a stock facility 13. The cold insulation boxes 5 and the cold insulating material 4 stored in the stock facility 13 are supplied to the respective package packing facilities 3*a* and 3*b* as required, for being used for distributing the commodities requiring cold packing 2.

Since the above-mentioned constitution allows the distribution volumes of the cold insulation boxes 5 and the cold insulating material 4 to be averaged, it is advantageous for the rental agent.

As described above, the renewing facility 12 and the stock facility 13 or the renewing and stock facility 14 can be located at an adequate place, and unlike the above-mentioned example, they can also be located in the same space as or adjacent to or near that of the distribution facility 9*a* or 9*b*, and the number of facilities can also be selected as desired.

The opening action proving tapes 15 are described below in reference to FIGS. 3 to 9.

As shown in the drawings, each of the opening action proving tapes 15 has an adhesive layer 17 provided on the back side of a transparent or light-transmitting tape proper 16, and one end of it is pre-stuck to the cover 5*b* while the other end not stuck to the box body 5*a* has a portion 18 on the back of the tape proper 16. The portion 18 is more adhesive to the adhesive layer 17 but can be separated from the other region. The portion 18 is illustrated as a flat form in the example, but it is actually a disc. Furthermore, the adhesive layer 17 on the back of the tape proper 16 at the other end is covered with releasing paper 19, for being protected till it is used.

In the above constitution, the commodity requiring cold packing 2 is accommodated in the cold insulation box 5 together with the cold insulating material 4, and the cover 5*b* is coupled with the box body 5*a*, to establish the package 6. Then, from each of the opening action proving tapes, the releasing paper 19 is removed, and the adhesive layer 17 is stuck to the box body 5*a*, for distribution in this state.

The work of sticking the opening action proving tape 15 is carried out additionally when the package 6 is established. However, since one end of the opening action proving tape 15 is pre-stuck to the cover 5*b*, the work of sticking the opening action proving tape 15 is merely to remove the releasing paper 19 at the other end and to stick the other end to the box body. So, the work is easy.

Figure 3:
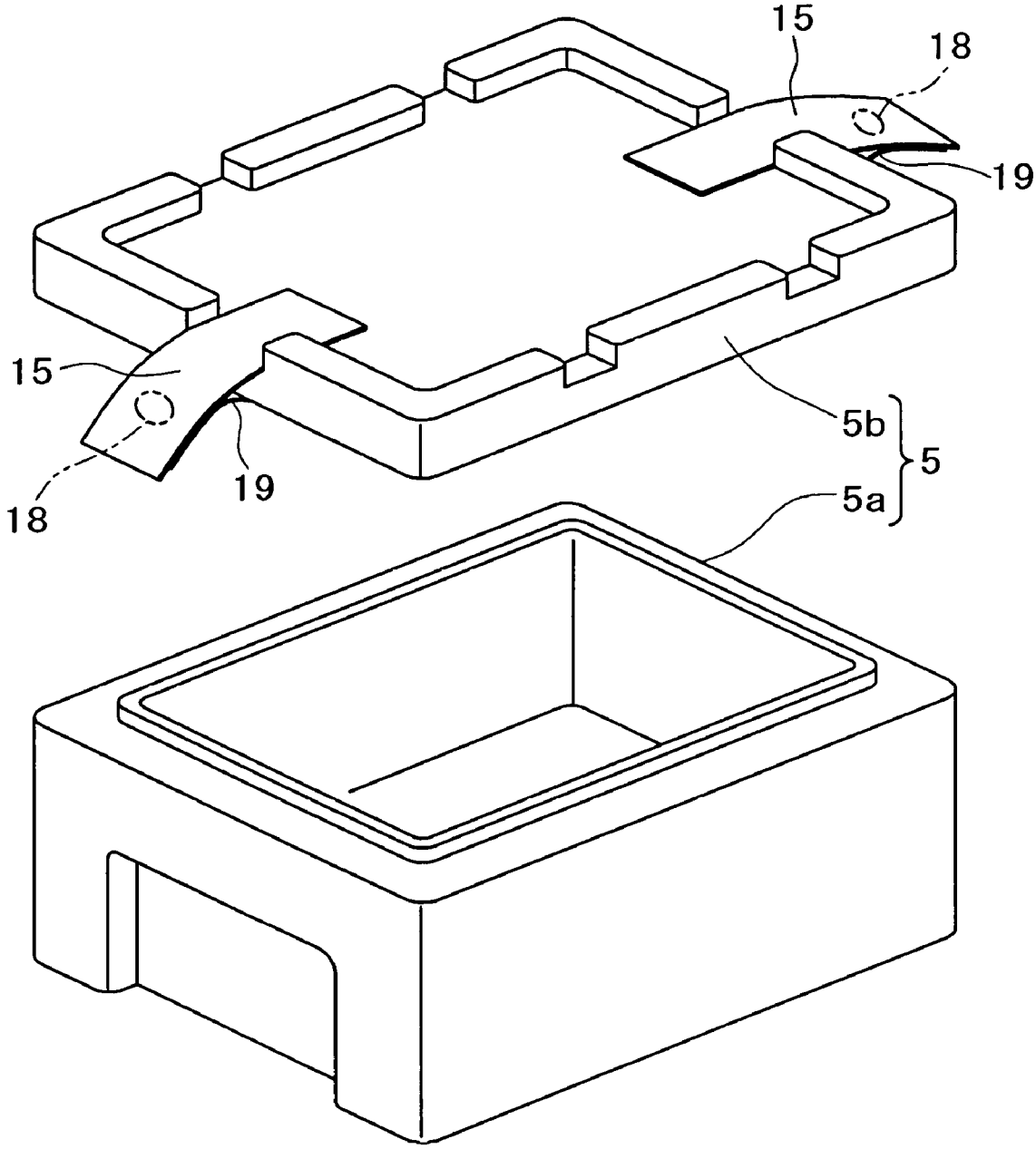
FIG. 3 is a perspective view showing an example of a cold insulation box used in the system for distributing the commodities requiring cold packing of this invention.
Figure 4:
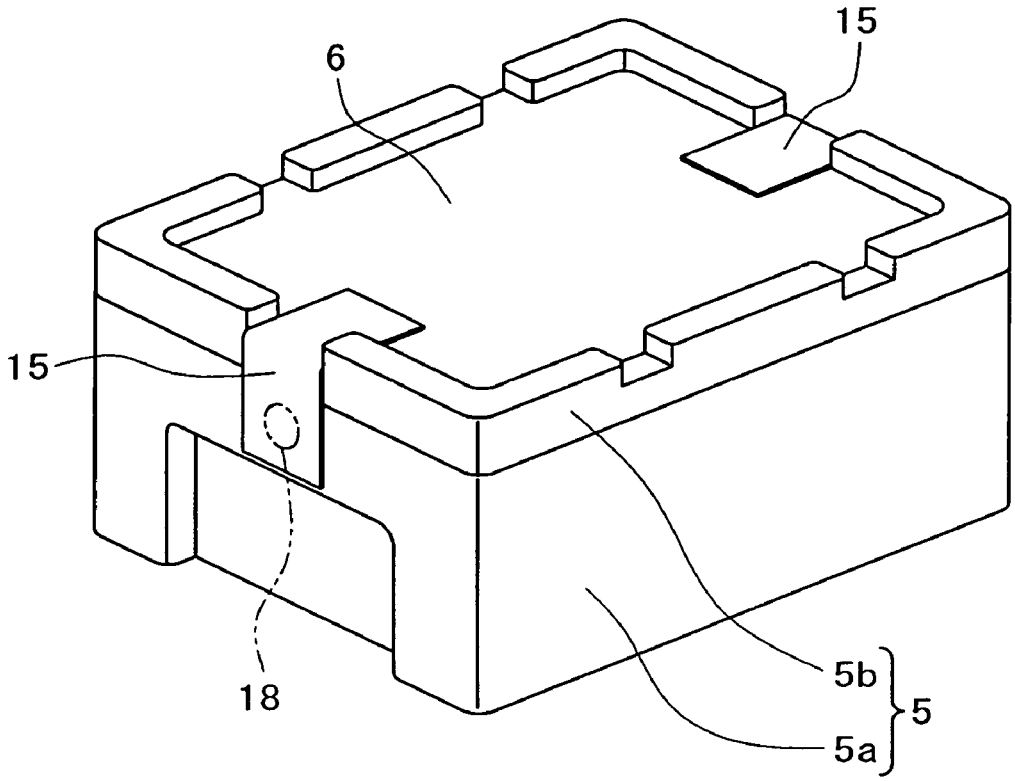
FIG. 4 is a perspective view showing a state in which opening action proving tapes are stuck to a package having a predetermined commodity kept in the cold insulation box of FIG. 3.
Figure 5:
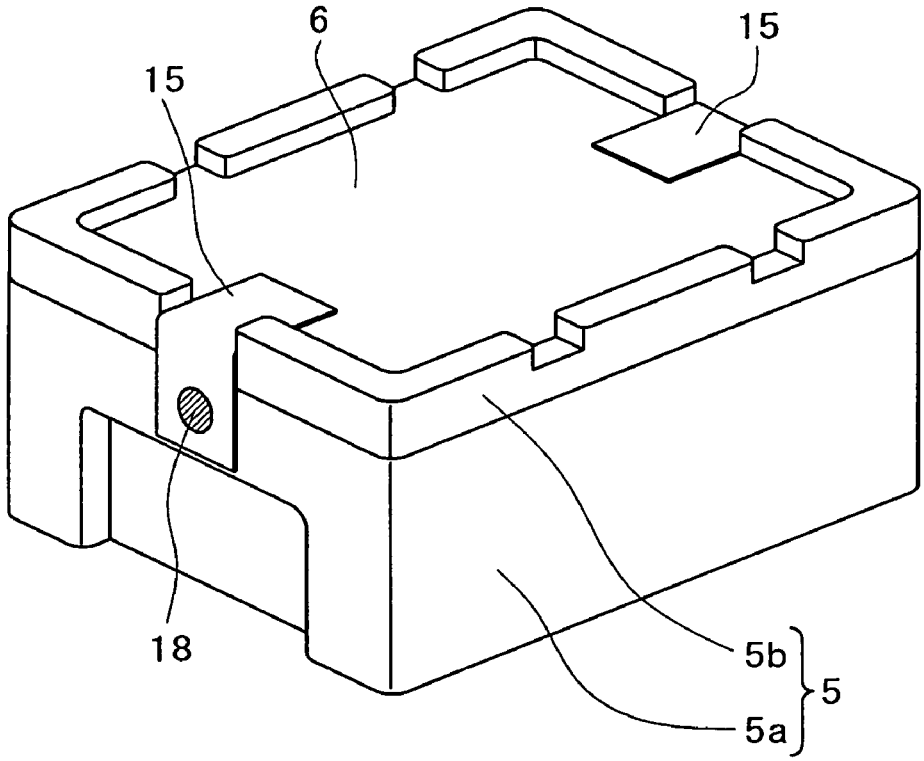
FIG. 5 is a perspective view showing a state in which the opening action proving tapes once removed from the state of FIG. 4 are stuck carefully to restore the state of FIG. 4.
Figure 6:
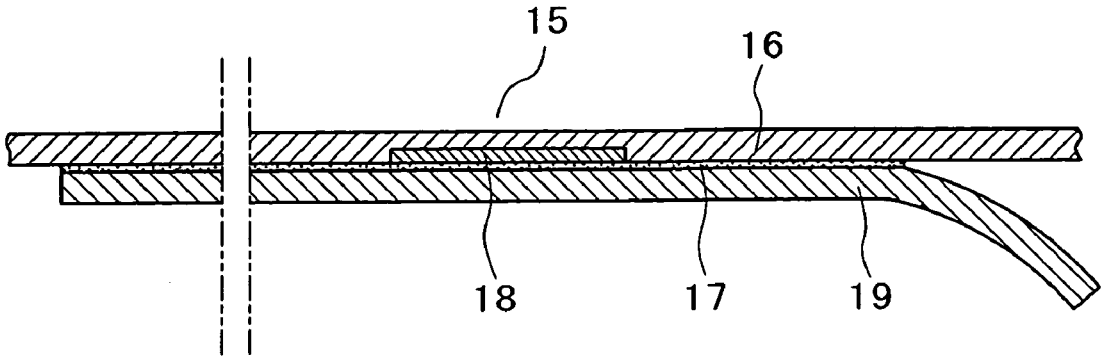
FIG. 6 is a sectional view showing an example of the opening action proving tapes.
Figure 7:
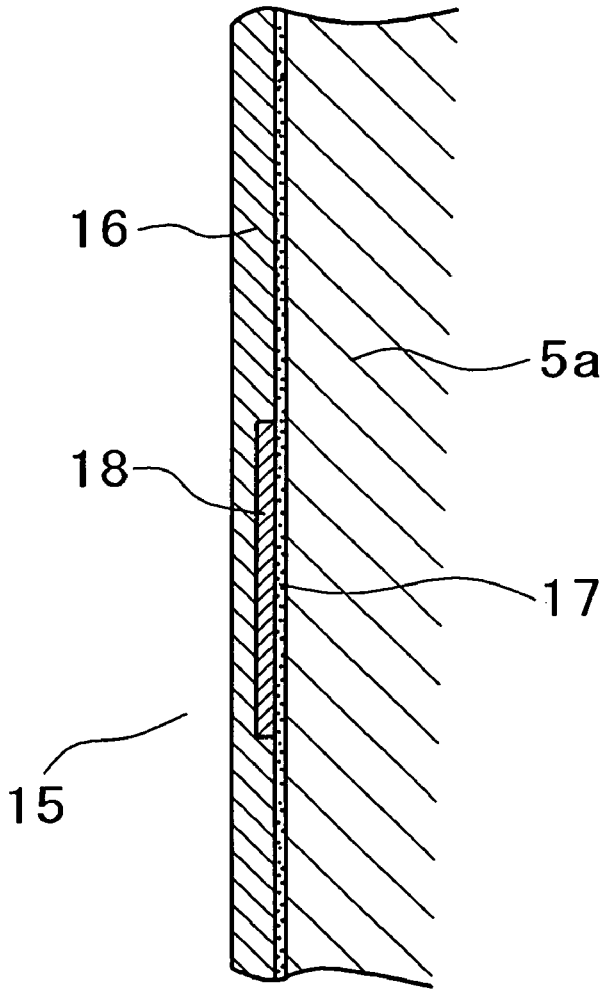
FIG. 7 is a sectional view showing an example of the opening action proving tapes.

With regard to the opening action proving tape 15 to be stuck to the package 6 as described above, if the tape is not used without sticking the other end as shown in FIG. 3, or if the tape is merely stuck to the package 6, the portion 18 that is not separated from the other region is invisible.

Figure 8:
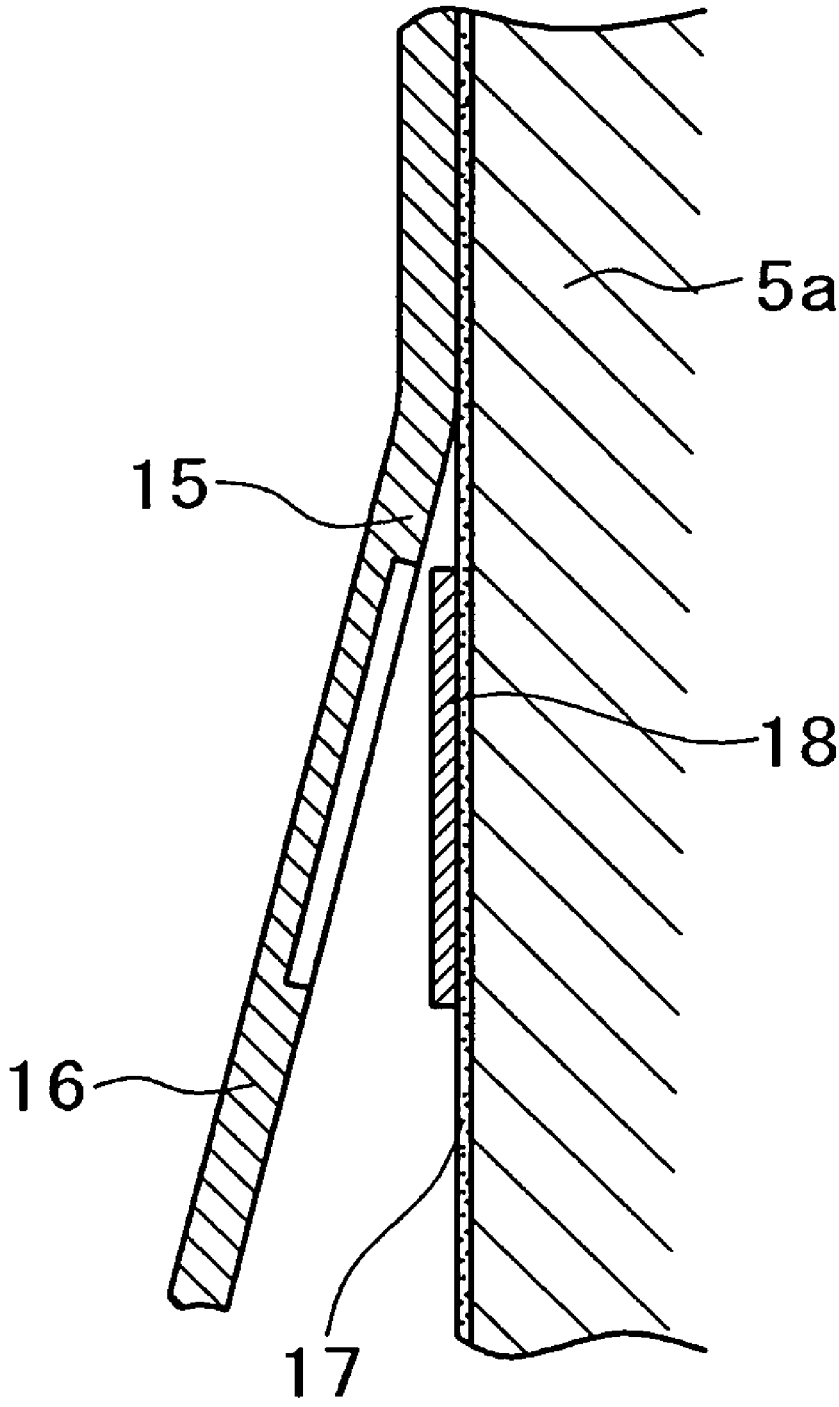
FIG. 8 is a sectional view showing an example of the opening action proving tapes.
Figure 9:
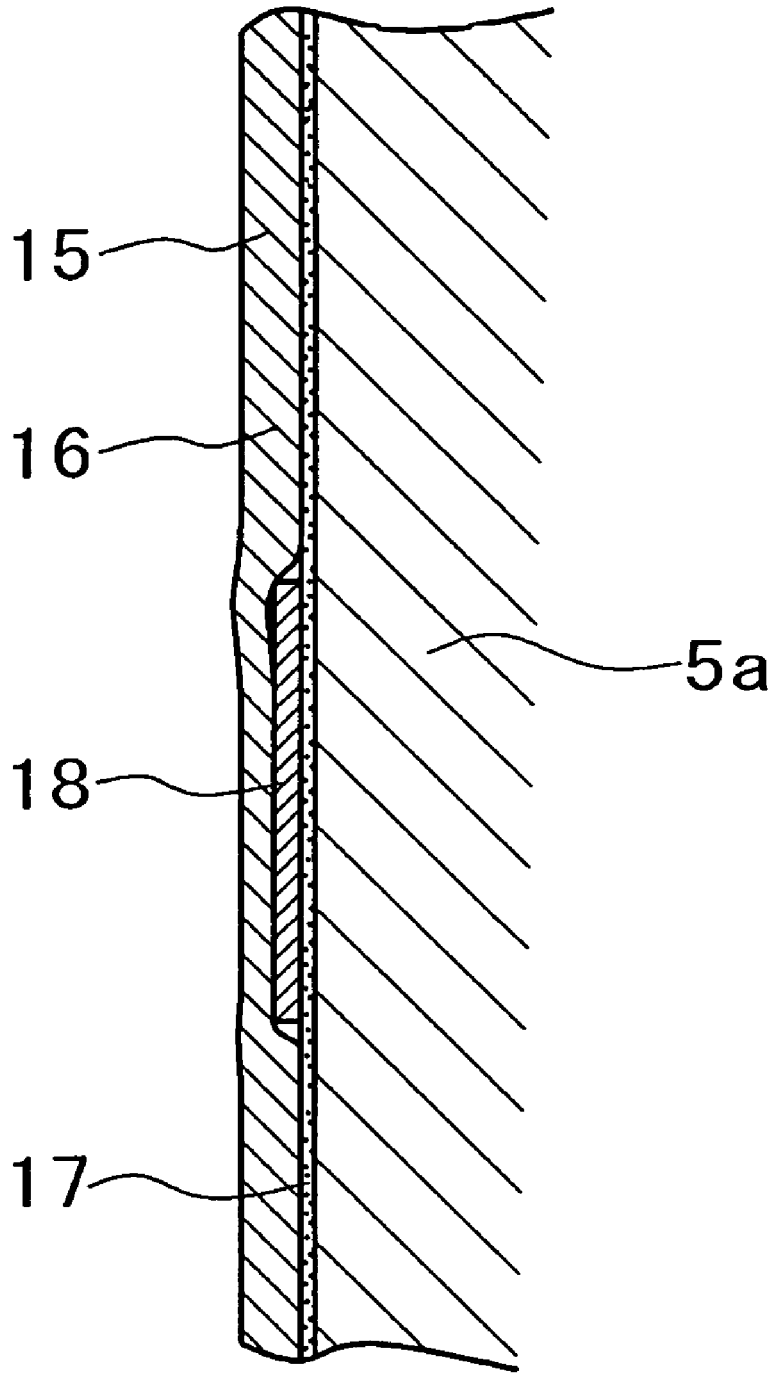
FIG. 9 is a sectional view showing an example of the opening action proving tapes.

However, if one end of the opening action proving tape 15 once stuck is removed as shown in FIG. 8, the portion 18 that is more highly adhesive to the adhesive layer 17 than to the other region is separated from the other region of the tape proper 16, to remain on the box body 5*a*.

Therefore, in the case where the opening action proving tape 15 is stuck again to the box body 5*a* in this state, even if it is carefully tried to let the other region of the tape proper 16 suit the portion 18, it is actually difficult. After all, the border between them is clearly visible.

Therefore, even if the opening action proving tape 15 once removed to open the cover 5*b* is carefully stuck again in an attempt to make the tape look like a tape that has never been removed before, the portion 18 is clearly visible in distinction from the other region. So, the once removed opening action proving tape 15 cannot be stuck to look like a tape that has never been removed before.

Thus, in the case where the cover is opened somewhere during distribution, this fact can be confirmed according to this invention, and if any predetermined action is taken in this case, the safety of the commodity requiring cold packing can be enhanced.

In the above-mentioned example of the system, the opening action proving tapes 15 are stuck to the package 6. However, for example, in the case where a box with a multi-layer structure consisting of an outer stiff structural member and an inner thermally insulating material, that is, a structure called a cooler box as described before is used together with a cover having a locking mechanism, it is not necessary to use the opening action proving tapes 15.

INDUSTRIAL APPLICABILITY

This invention as described above provides the following numerous advantages in the distribution of commodities requiring cold packing.

1. Presently cold insulation boxes are used only once since it is difficult to re-use them. However, in this invention, since they can be washed and sterilized for being renewed to allow repetitive use, sanitation is assured and wasteful consumption of resources can be avoided while the problem of waste can be solved.

2. Since ice or dry ice is not used as the cold insulating material, the problems involved in the use of them as described before can be solved.

3. If anti-freezing enclosed containers respectively filled with a hygroscopic polymer-based cold insulating agent are used as the cold insulating material, the temperature can be set in response to the commodities requiring cold packing, and the temperature difference from room temperature can be kept smaller than that of dry ice. So, the effect of cold insulation can be maintained for a long period of time. Furthermore, since the freezing and storing temperature can also be elevated compared with that of dry ice, freezing and storage can be facilitated. For these reasons, it is not necessary at all that the cold insulation boxes are opened for being re-charged with the cold insulating material somewhere in the distribution route from the package packing facility through the distribution facility to customers, unlike the case of using dry ice or ice as the cold insulating material.

4. Since it is not necessary to open the cold insulation boxes somewhere in the distribution route from the package packing facility through the distribution facility to the customers as described above, the quality of the accommodated commodities requiring cold packing can be positively maintained.

5. Additionally in this invention, in the case where a cover is opened during distribution, the fact of opening can be confirmed. So, a predetermined action can be taken to very highly enhance the safety of the commodity requiring cold packing.

6. If the cold insulation boxes and the cold insulating material, the distribution volumes of which change in response to the distribution volume of the commodities requiring cold packing, are made rentable, and the rental agent manages the renewing facility and the stock facility, then it is not necessary that the distributor manages the cold insulation boxes, the cold insulating material and the facilities. So, the distributor can greatly enjoy the advantage of lower risk.

7. If the cold insulation boxes and the cold insulating material are supplied from the renewing facility and the stock facility to the package packing facilities of plural distributors, the distribution volumes of the cold insulation boxes and the cold insulating material can be averaged advantageously.

What is claimed is:

1. A system for distributing commodities requiring cold packing, said system comprising:

a package packing facility for accommodating the commodities requiring cold packing, into repetitively usable cold insulation boxes together with a repetitively usable cold insulating material, to establish packages, a distribution facility for stacking packed packages for distribution to customers, a renewing facility for renewing used cold insulating material and used cold insulation boxes to allow their reuse, and a stock facility for stocking renewed cold insulating material and renewed cold insulation boxes;

wherein said renewing facility and stock facility are provided in the same space as the package packing facility.

2. A system for distributing commodities requiring cold packing, said system comprising:

a package packing facility for accommodating the commodities requiring cold packing, into repetitively usable cold insulation boxes together with a repetitively usable cold insulating material, to establish packages, a distribution facility for stacking packed packages for distribution to customers, a renewing facility for renewing used cold insulating material and used cold insulation boxes to allow their reuse, and a stock facility for stocking renewed cold insulating material and renewed cold insulation boxes;

wherein said renewing facility and stock facility are positioned common to plural package packing facilities.

3. The system of claim 2, wherein said repetitively usable cold insulating material comprises anti-freezing enclosed containers respectively filled with a hygroscopic polymer-based cold insulating material.

4. The system of claim 2, wherein said repetitively usable cold insulation boxes comprise polypropylene foam.

5. The system of claim 2, wherein said repetitively usable cold insulation boxes are formed of a plastic composite resin foam.

6. The system of claim 2, wherein each of said repetitively usable cold insulation boxes is a box with a multi-layer structure consisting of an outer structural material and an inner thermally insulating material.

7. The system of claim 2, wherein said cold insulating material and cold insulation boxes are rentable.

8. The system of claim 7, wherein a rental agent manages the renewing facility and stock facility.

9. A system for distributing commodities requiring cold packing, said system comprising:

a package packing facility for accommodating the commodities requiring cold packing, into repetitively usable cold insulation boxes together with a repetitively usable cold insulating material, to establish packages, a distribution facility for stacking packed packages for distribution to customers, a renewing facility for renewing used cold insulating material and used cold insulation boxes to facilitate their reuse, and a stock facility for stocking renewed cold insulating material and renewed cold insulation boxes;

wherein each of said cold insulation boxes consists of a box body and a cover, and opening action proving tapes are stuck to straddle the box body and the cover coupled with each other.

10. The system of claim 9, wherein each of said opening action proving tapes has one end pre-fixed to either the cover or the box body; and another end of the tape has a portion to be bonded to the other member; and a region of the portion to be bonded at the other end is differently adhesive to facilitate detection of any of the cold insulation box.

* * * * *